US005440901A

United States Patent [19]

Seino et al.

[11] Patent Number: 5,440,901

[45] Date of Patent: Aug. 15, 1995

[54] PICKER DEVICE OF HOSIERY KNITTING MACHINE

[75] Inventors: Masahiro Seino; Minoru Oboshi; Satoshi Okoshi; Kazuhiko Tamaki, all of Nishi, Japan

[73] Assignee: Nagata Seiki Kabushiki Kaisha, Tokyo, Japan

[21] Appl. No.: 256,892

[22] PCT Filed: Dec. 1, 1993

[86] PCT No.: PCT/JP93/01748

§ 371 Date: Jul. 28, 1994

§ 102(e) Date: Jul. 28, 1994

[87] PCT Pub. No.: WO94/12712

PCT Pub. Date: Jun. 9, 1994

[30] Foreign Application Priority Data

Dec. 1, 1992 [JP] Japan ..... 4-082912 U
Apr. 7, 1993 [JP] Japan ..... 5-080882

[51] Int. Cl.[6] ..... D04B 9/20; D04B 9/46
[52] U.S. Cl. ..... 66/47; 66/48
[58] Field of Search ..... 66/47, 48, 51, 52

[56] References Cited

U.S. PATENT DOCUMENTS 3,535,893 10/1970 Boyer, Jr. ..... 66/48

FOREIGN PATENT DOCUMENTS 166611 1/1922 Japan .
295257 4/1931 Japan .
13315756 9/1957 Japan .

*Primary Examiner*—John J. Calvert
*Attorney, Agent, or Firm*—Ladas & Parry

[57] ABSTRACT

A picker device having an up-picker mechanism (A) and a down-picker mechanism (B) for increasing and decreasing stitches in knitting a heel portion and a toe portion of hosiery. When the knitting of the heel portion or the toe portion is started, a short butt (2*a*) of a knitting needle in a knitting level comes in contact with a front end portion (17*a* or 18*a*) of an up-picker (17 or 18) as a knitting cylinder alternately rotates forward and backward. The up-picker (17 or 18) is thereby rotated horizontally and a rear end portion (17b or 18b) of the up-picker (17 or 18) is guided by an inclined guide slot (20*a* or 20*b*), so that the rear end portion (17*b* or 18*b*) is lowered and thus thus the front end portion (17*a* or 18*a*) of the up-picker (17 or 18) is raised. The knitting needle (2) is thereby raised from above a stitch cam (9*a* or 9*b*) to a position above a center cam (8), whereby the knitting needle (2) is moved to a non-knitting level and thus one stitch is decreased. When one stitch is increased, the short butt (2*a*) of the knitting needle (2) in the non-knitting level presses a front end portion (25*a*) of a down-picker (25). The down-picker (25) is guided by an inclined cam portion (21*a*1 or 21*a*2) and thereby lowered. Thus, the knitting needle is returned to the knitting level. An actuator (29) that is controlled with a signal received from a knitting control unit (35) locks the front end portion (25*a*) of the down-picker (25) to a predetermined position. Malfunction or the like of the knitting machine caused by rebounding of the pickers (17, 18, and 25) is suppressed by coil springs (19*a* and 33).

13 Claims, 12 Drawing Sheets

PICKER DEVICE OF HOSIERY KNITTING MACHINE

TECHNICAL FIELD

The present invention relates to a picker device of hosiery knitting machine for knitting a heal portion and a toe portion of hosiery by plain knitting method, a jacquard knitting method, and the like, and in particular, to a picker device including an up-picker and a down-picker.

BACKGROUND ART

Conventionally, stockings and socks (hosiery) are knitted in the order of a leg portion, a heel portion, an instep portion, and a toe portion. The heel portion and the toe portion are knitted by increasing and decreasing stitches along a gore line. The heel portion and the toe portion of hosiery are knitted by a picker device that has an up-picker and a down-picker. Conventionally, the leg portion and the instep portion are knitted by continuously rotating a knitting cylinder of the knitting machine. On the other hand, when the heel portion and the toe portion are knitted, the knitting cylinder is switched to oscillation or alternate forward and backward rotation. When the heel portion or the toe portion is knitted, the number of stitches is gradually decreased and then increased. When the stitches are decreased, a butt of a knitting needle is raised by an up-picker and the knitting needle is moved to a non-knitting level over a center cam. On the other hand, when the stitches are increased, a knitting needle in the non-knitting level is lowered to a knitting level by a down-picker. Whenever the knitting cylinder of the knitting machine is oscillated or rotates forward and backward, the up-picker and the down-picker are abutted by butts of knitting needles at their forward ends, thereby raising and lowering the respective knitting needles. Conventionally, a pair of up-pickers are provided. These up-pickers are referred to as a left-side up-picker and a right-side up-picker. These up-pickers are connected by a connecting member so that they move in liaison in vertically different directions. A plate-shaped picker cam is used to raise the up-picker while holding a needle butt. Likewise, for the down-picker, another picker cam is used. This picker device is disclosed in Japanese Patent Laid-Open Publication No. 31-8933.

In the above described device, when the frequency of the oscillating motion of the knitting cylinder becomes high as the speed of the knitting machine is increased, there occurs wear of the connecting plate connecting the left-side up-picker and right-side up-picker and the connecting pins therebetween. Thus, the knitting operation becomes unstable and thereby the knitting machine malfunctions with resultant lack in reliability. In addition, since the construction of the picker device is complicated, the assembling, adjustment, maintenance and inspection become troublesome.

In the preceding paragraph, problems involved in the conventional up-picker and down-picker were described with respect to the ordinary plain knitting and tuck knitting.

On the other hand, when a variety of patterns are knitted, one to four yarn feeders for knitting motif patterns may be provided along with one or two ground yarn feeders for knitting jacquard patterns. When four pattern yarn feeders are provided, a motif pattern with four colors can be knitted.

For example, in the case of knitting a jacquard pattern wherein the width of the pattern is narrow, no problem will occur even if the width of a knitting needle group in a knitting course is narrower than the width of the front end of the down-picker. On the other hand, if the width of the knitting needle group in the knitting course (that is the width of a region lacking the knitting needles in a non-knitting course) is greater than the width of the front end of the down-picker, the front edge of the down-picker is raised, in the knitting needle lacking region, from a low non-operative position to a high position immediately below a leveling cam. Thus, knitting needles that should not participate in the pattern knitting come in contact with the front end of the down-picker. Consequently, the knitting needles are lowered from the non-knitting level to the knitting level, thereby disordering the jacquard pattern of the instep portion and making it impossible to knit the heel portion.

Objects of the present invention are to solve the above described problems. A main object of the present invention is to provide a picker device of hosiery knitting machine that can prevent wear of a connecting portion of an up-picker and a down-picker and that can be relatively simply constructed.

Another object of the present invention is to provide a picker device of hosiery knitting machine that can correctly knit a jacquard pattern without defect of a heel portion even if the width of a knitting needle lacking region in a non-knitting course is greater than the width of the front end of a down-picker.

DISCLOSURE OF THE INVENTION

The present invention is a picker device of a hosiery knitting machine having a knitting cylinder, a machine frame provided outside the knitting cylinder, a center cam, a pair of first and second stitch cams, and a leveling cam, the knitting cylinder supporting a number of knitting needles for upward and downward movement, the knitting needles having butts, respectively, the center cam being supported by the machine frame, the first and second stitch cams being disposed on both sides of the center cam, the leveling cam being supported by the machine frame, the picker device comprising, an up-picker mechanism, and a down-picker mechanism, wherein the up-picker mechanism comprises, a first up-picker formed in a lever shape and having a first front end portion and a first rear end portion, the first front end portion being disposed above the first stitch cam, the first rear end portion being disposed on a far side of the knitting cylinder, a first support means for supporting the first up-picker at an intermediate portion thereof so that the first up-picker is rotatable about a vertical axis and a horizontal axis, a second up-picker formed in a lever shape and having a second front end portion and a second rear end portion, the second front end portion being disposed above the second stitch cam, the second rear end portion being disposed on a far side of the knitting cylinder, a second support means for supporting the second up-picker at an intermediate portion thereof so that the second up-picker is rotatable about a vertical axis and a horizontal axis, a first inclined guide means engaging the rear end portion of the first up-picker for gradually lowering the first rear end so as to move the first front end portion of the first up-picker to an upper position above the center cam along with a knitting needle that is caused to abut against the first front end portion, when the butt of the knitting needle in a knitting level of the knitting cylinder rotating in a first direction is caused to move to and abut against the first front end portion of the first up-picker to move the first front end portion in such a manner that the first up-picker is rotated about the vertical axis, a first elastic means for applying such a force to the first up-picker to lower the first front end portion, a second inclined guide means engaging the second rear end portion of the second up-picker for gradually lowering the second rear end so as to move the second front end portion of the second up-picker to an upper position above the center cam along with a knitting needle that is caused to abut against the second front end portion, when the butt of the knitting needle in a knitting level of the knitting cylinder rotating in a second direction is caused to move to and abut against the second front end portion of the second up-picker to move the second front end portion in such a manner that the up-picker is rotated about the vertical axis, a second elastic means for applying such a force to the second up-picker to lower the second front end portion, and interconnection means for coupling and rotating the first up-picker and the second up-picker in the same direction about the vertical axis and in opposite directions about the horizontal axis, wherein the down-picker mechanism comprises, a down-picker having a front end portion and a rear end portion, the front end portion being disposed immediately below the leveling cam, the rear end portion being disposed on a far side of the knitting cylinder, the down-picker being supported at the rear end portion thereof for upward and downward rotation by a horizontal shaft, means for supporting the rear end portion of the down-picker so that the down-picker is rotatable horizontally from a neutral position, a cam guide means for moving the down-picker downward when the down-picker is rotated horizontally from the neutral position, a locking means for locking rotating position of the horizontal shaft so that the down-picker is selectively placed at a first rotating position or a second rotating position of the horizontal shaft, the front end portion of the down-picker being at the first rotating position adapted for contact with the butt of the knitting needle in the non-knitting level, the front end portion of the down-picker at the second rotating position being free from contact with the butt of the knitting needle in the non-knitting level, and an elastic means for urging the down-picker toward the leveling cam.

BEST MODES FOR CARRYING OUT THE INVENTION

Next, with reference to the accompanying drawings, embodiments of the present invention will be described.

Up-picker mechanism

Figure 1:
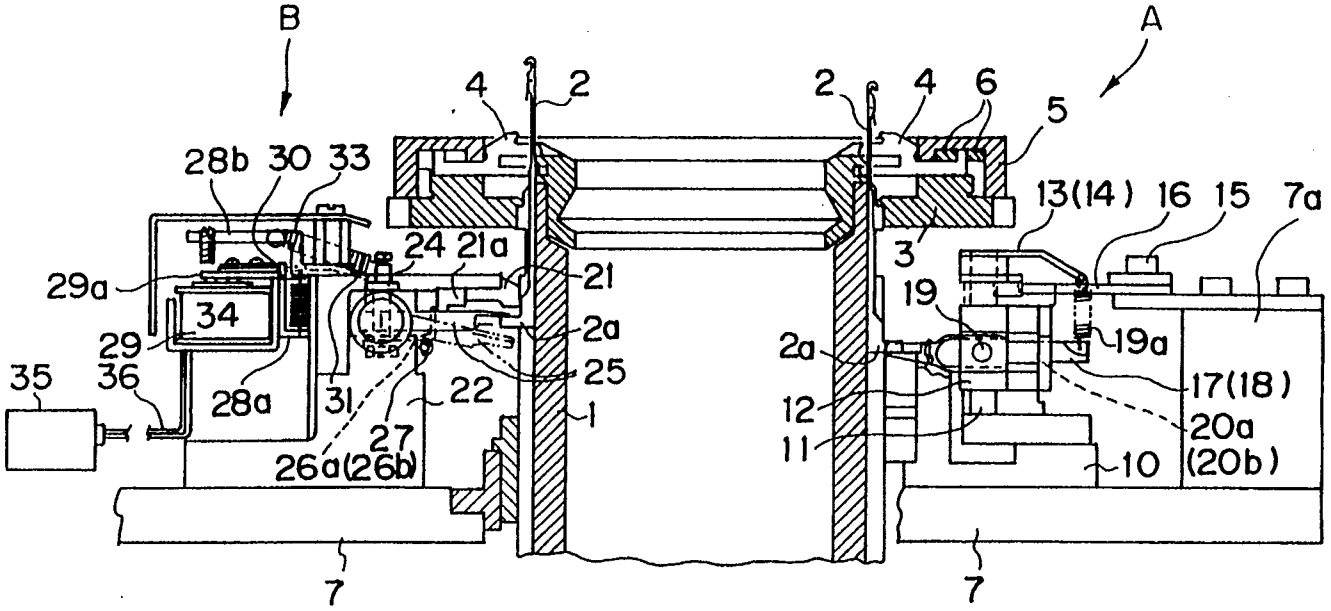
FIG. 1 is a side sectional view showing part of a picker device of hosiery knitting machine according to the present invention.

In FIG. 1, reference numeral 1 designates a knitting cylinder of a hosiery knitting machine. As is known in the art, the knitting cylinder 1 is rotated either in one direction continuously or in two directions (forward and backward) about a vertical axis thereof. A large number of vertical needle grooves are formed on the outer peripheral surface of the knitting cylinder 1. Knitting needles 2 are inserted into the needle grooves, respectively. The knitting needles 2 are movable upward and downward. There are two types of knitting needles 2, one of which has a short butt 2*a*, the other of which has a long butt 2b (see FIG. 8). The knitting needles 2 with the butt 2*a* are used for knitting a heel portion and a toe portion of hosiery as will be descried later.

A sinker bed 3 is disposed at an upper portion of the knitting cylinder 1. The sinker bed 3 has known sinkers 4. The sinkers 4 are slidable in radial directions of the knitting cylinder 1 by sinker cams 6 disposed on a sinker cap 5. The sinker cams 6 operate the sinkers 4 in synchronization with the upward and downward motions of the knitting needles 2, thereby knitting the hosiery.

Figure 2:
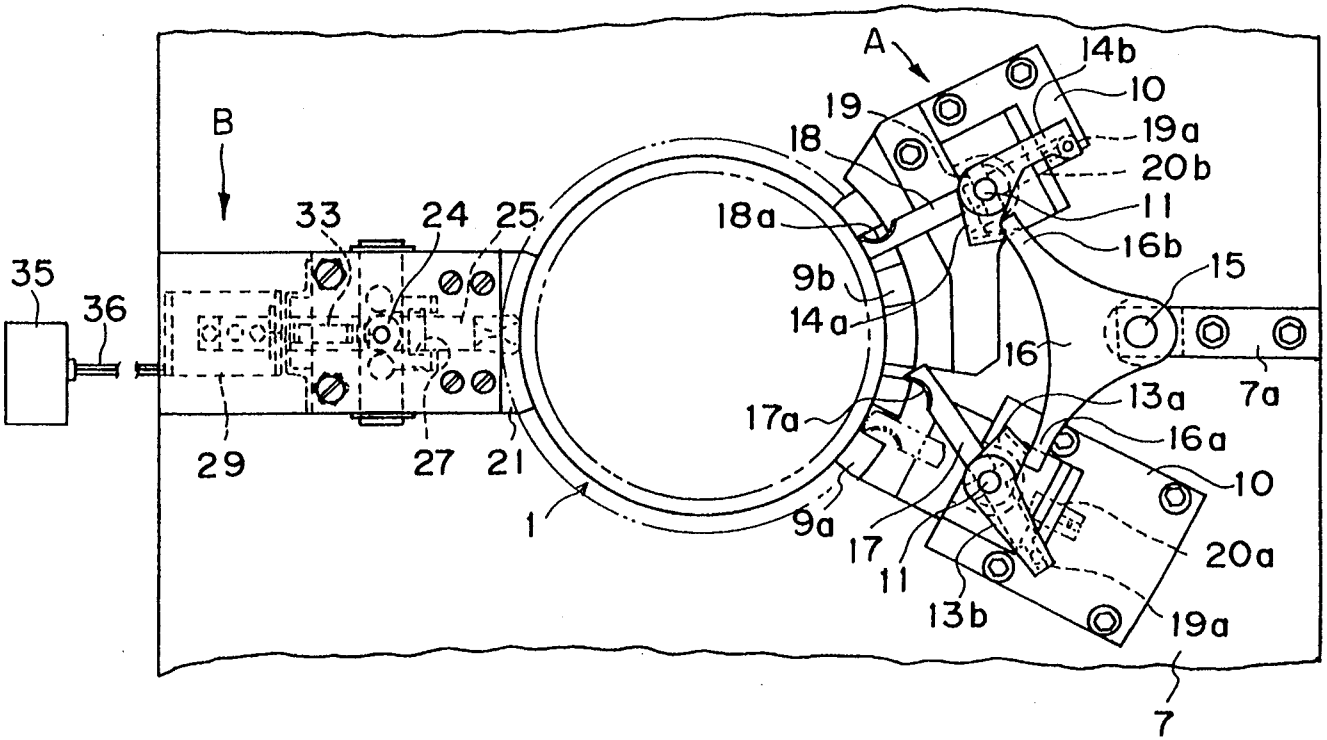
FIG. 2 is a plan view of FIG. 1.
Figure 3:
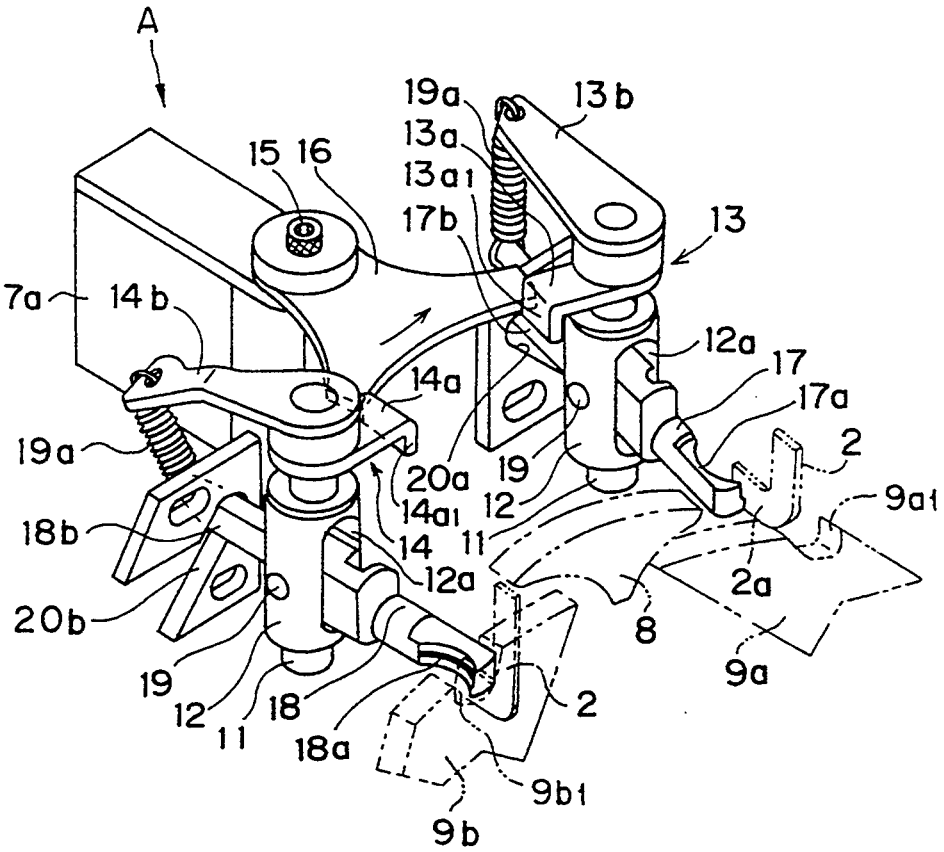
FIG. 3 is a perspective view showing an up-picker mechanism of FIGS. 1 and 2.
Figure 7:
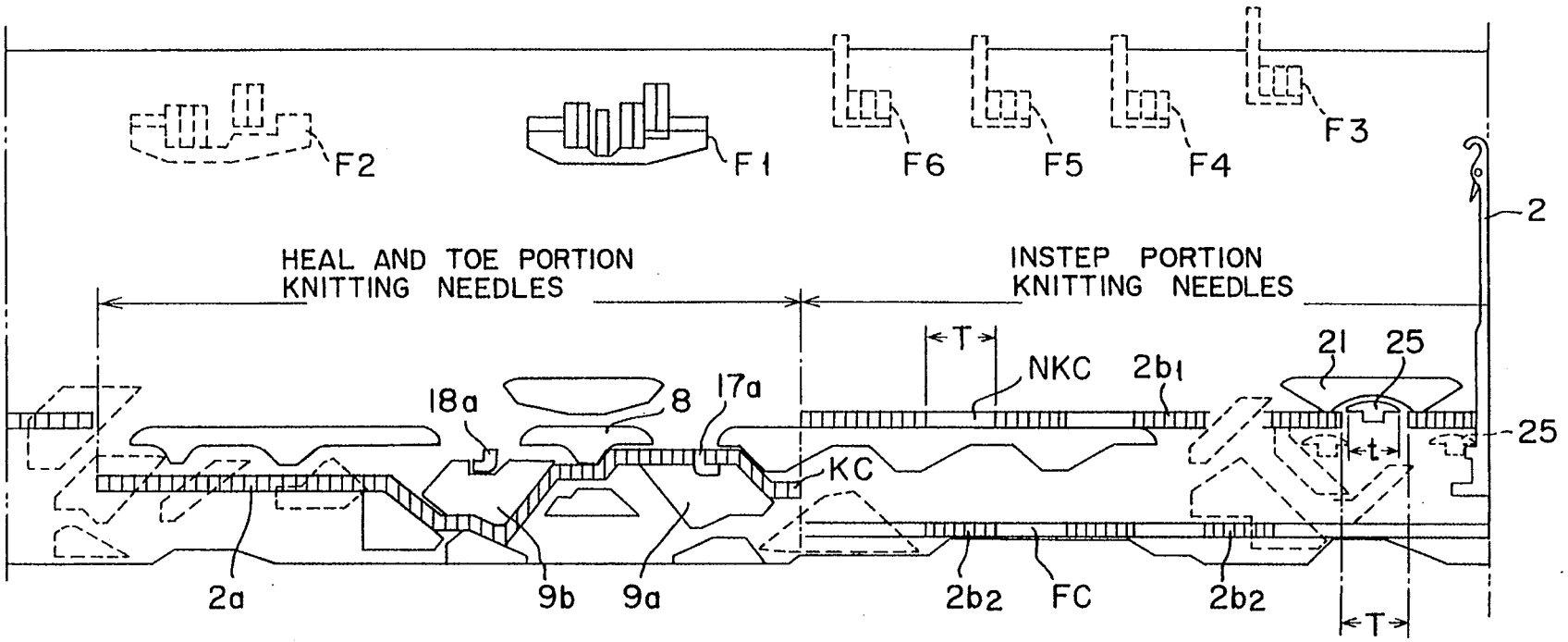
FIG. 7 is a development diagram showing positions of cams and yarn feeders.

As shown in FIGS. 3 and 7, a center cam 8, a right-side stitch cam 9*a*, and a left-side stitch cam 9*b* are supported by a machine frame 7 disposed outside the knitting cylinder 1. A pair of brackets 10 are disposed in the vicinity of the left-side and right-side stitch cams 9*a* and 9*b* and on the machine frame 7. As shown in FIG. 2, the brackets 10 are pivoted by vertical shafts 11. As shown in FIG. 3, enlarged trunk portion 12 are integrally formed in the middle of the vertical shafts 11. Bell-crank-shaped swing levers 13 and 14 are pivoted at upper portions of the vertical shafts 11. Bent pieces 13*a*1 and 14*a*1 are formed on arm levers 13*a* and 14*a* of the swing levers 13 and 14, respectively. A center portion of a swingable interconnection lever 16 is disposed on a machine table 7*a* (also see FIGS. 1 and 2) that is incorporated into the machine frame 7. The center portion of the interconnection lever 16 is pivoted by a vertical support shaft 15. Free end portions 16*a* and 16*b* (see FIG. 2) of the interconnection lever 16 are in contact with the bent pieces 13a1 and 14a1, respectively so that the interconnection lever 16 moves in association with the arm levers 13a and 14a. As shown in FIG. 3, through slots 12a are formed in the middle of the trunk portions 12. The slots 12a extend along the trunk portion 12. A first (right-side) up-picker 17 and a second (left-side) up-picker 18 are passed through, and pivoted within the right-side and left-side slots 12a of the trunk portion 12, respectively. The first up-picker 17 and the second up-picker 18 are swingable upward and downward along the slots 12a.

Picker front end portions 17a and 18a are formed on the up-pickers 17 and 18, respectively, at their ends adjacent to the knitting cylinder 1. Known recess portions that are adapted to be abutted by, and support the butts 2a are formed on mutually remote sides of the front end portions 17a and 18a. As shown in FIGS. 2 and 3, the front end portions 17a and 18a are disposed in the vicinity and above the first stitch cam 9a and the second stitch cam 9b, respectively. Thus, the end portions 17a and 18a can be lowered into recesses 9a1 and 9b1 in the upper center portions of the stitch cams 9a and 9b, respectively. The up-pickers 17 and 18 have rear end portions 17b and 18b, respectively. The rear end portions 17b and 18b are disposed on the far side relative the knitting cylinder 1. The swing levers 13 and 14 have arm portions 13b and 14b, respectively. The rear end portions 17b and 18b and the arm portions 13b and 14b of the swing levers 13 and 14 are connected by tension coil springs 19a, respectively. The rear end portions 17b and 18b of the up-pickers 17 and 18 are upwardly pulled by the tension coil springs 19a. Thus, as viewed in FIG. 3, the up-pickers 17 and 18 are always urged upward so that they are urged to rotate clockwise. Consequently, the picker end portions 17a and 18a are urged so as to engage in the recesses 9a1 and 9b1 at the upper edge portions of the right-side stitch cam 9a and the left-side stitch cam 9b, respectively. In addition, plate members are fixedly provided that have inclined guide slots 20a and 20b into which the rear end portions 17b and 18b are slidably fitted, respectively. As shown in FIG. 3, the inclined guide slots 20a and 20b are disposed so that their heights increase as they extend toward each other.

Thus, for example, in FIG. 3, when the butt 2a of a knitting needle 2 pushes the picker end portion 17a leftward, the up-picker 17 is rotated about the vertical shaft 11 clockwise, whereby the rear end portion 17b is guided downward by the inclined guide slot 20a. Thus, the picker edge portion 17a is raised so that it is placed above the center cam 8.

The above-described mechanism constitutes an up-picker mechanism A.

In the development diagram shown in FIG. 7, F1 and F2 represent yarn feeders used for knitting jacquard patterns. In addition to the yarn feeders F1 and F2, four yarn feeders F3, F4, F5, and F6 used for knitting motif patterns are provided.

Down-picker Mechanism

As shown in FIGS. 1 and 2, a down-picker mechanism B is provided at a diametrically opposite position relative to the up-picker mechanism A with respect to the knitting cylinder 1. Next, the down-picker mechanism B will be described.

Figure 4:
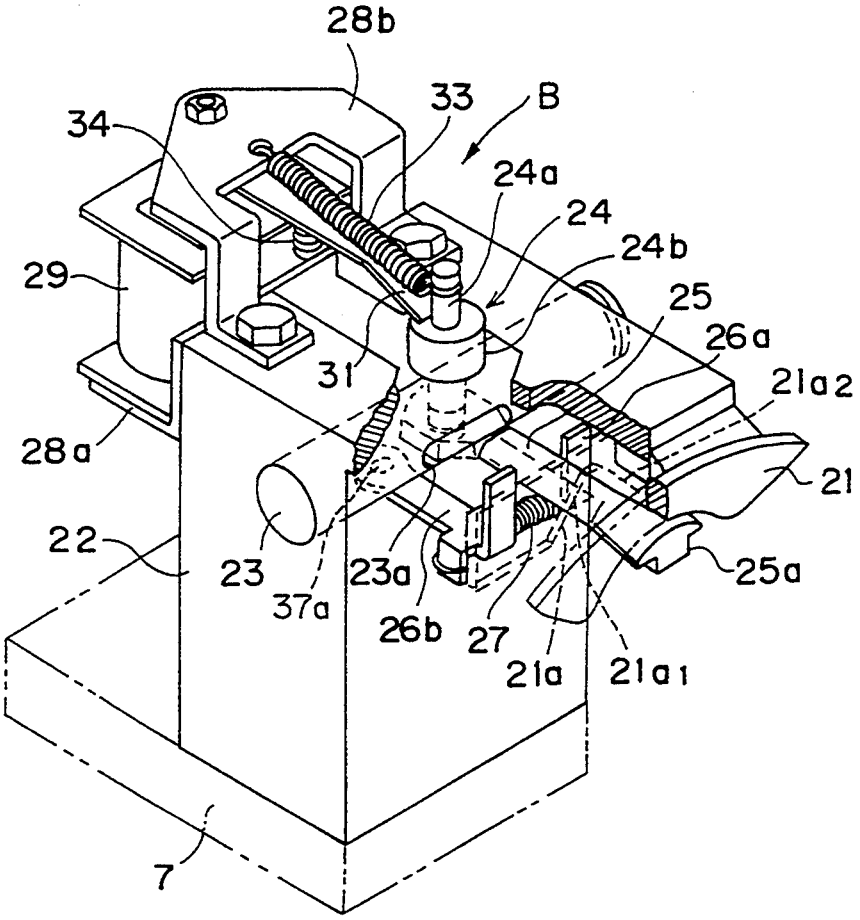
FIG. 4 is a perspective view showing a down-picker mechanism of FIGS. 1 and 2.
Figure 6:
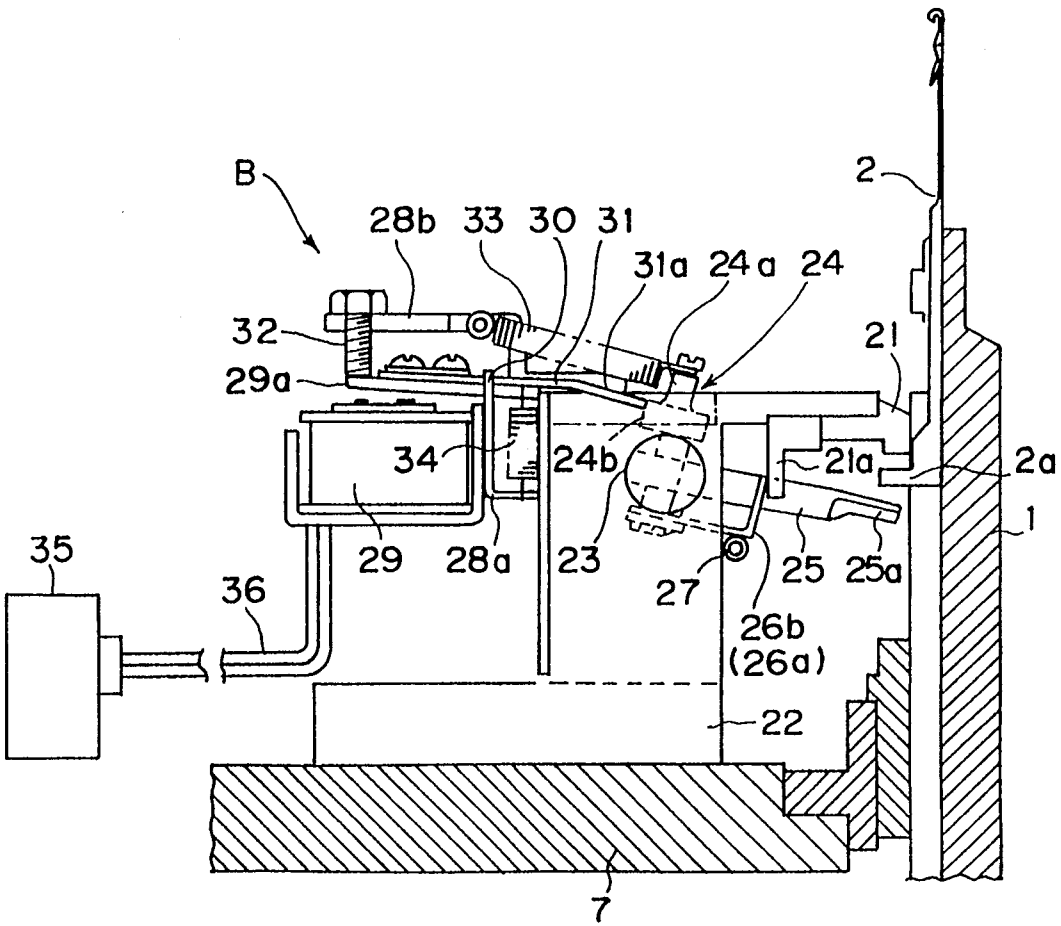
FIG. 6 is a partial sectional side view showing the down-picker mechanism in a different state.

A leveling cam 21 is provided so as to be opposed to the center cam 8 with the knitting cylinder therebetween in the diametric direction thereof. The leveling cam 21 is also shown in FIG. 7. As shown in FIG. 1, the leveling cam 21 is secured to a support member 22 on the machine frame 7 along with a pair of cam guide members 21a. A left-side inclined cam 21a1 and a right-side inclined cam 21a2 are provided on the lower edges of the cam guide members 21a, as shown in FIGS. 4 and 6, a horizontal shaft 23 is mounted horizontally on the support member 22. A stop shaft 24 is vertically implanted in the middle of the horizontal shaft 23. A small diameter portion 24a and a large diameter portion 24b are formed in an upper portion of the stop shaft 24. A slot 23a is defined in the middle of the horizontal shaft 23 in the axial direction thereof. A base portion of a rod-shaped down-picker 25 is pivoted by the stop shaft 24 in the slot 23a so as to be horizontally rotatable in the slot 23a. A pair of urging levers 26a and 26b are disposed below the horizontal shaft 23 and pivoted by pins 37a and 37b, respectively, so that the down-picker 25 can be returned to a neutral position by elastic force of a tension spring 27 disposed between the urging levers 26a and 26b. In FIG. 4, the pin 37b is not seen. Thus, a front end 25a of the down-picker 25 is normally placed at the neutral position and extends in a concavity formed in the lower portion of the leveling cam 21.

A pair of upper and lower mounting brackets 28b and 28a are secured to the rear of the support member 22. An actuator 29 such as an electromagnet is supported by the mounting bracket 28a. As shown in FIG. 6, an attraction piece 29a is disposed above the actuator 29. The attraction piece 29a is pivoted by a support 30. Thus, the attraction piece 29a can move upward and downward. A working piece 31 is formed integrally with the attraction piece 29a. A free end portion 31a extends from the working piece 31 so that the free end portion 31a can alternately come in contact with the small diameter portion 24a and the large diameter portion 24b. An adjusting screw 32 is threadedly passed in an end portion of the mounting bracket 28b so that the adjusting screw 32 can adjustably restrict the floating position of the attraction piece 29a. The mounting bracket 28b and the stop shaft 24 are connected by way of a tension coil spring 33. A knitting control unit 35 is connected to the actuator 29 by way of cables 36. The knitting control unit 35 stores a knitting program.

Operation

The operation of the above-described picker device will be described.

Figure 10:
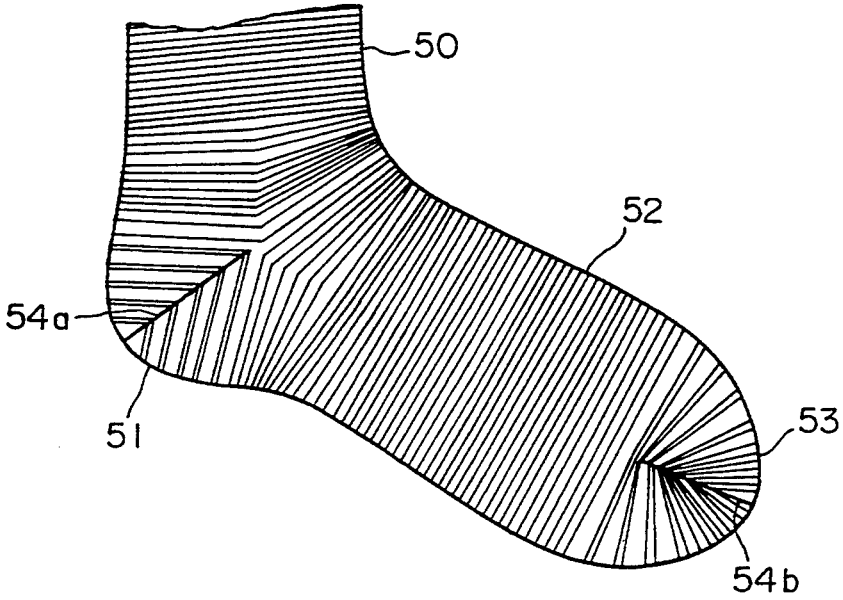
FIG. 10 is a schematic diagram for explaining various portions of hosiery.

As shown in FIG. 10, ordinarily hosiery is knitted in the order of a leg portion 50, a heel portion 51, an instep portion 52, and a toe portion 53. When the heel portion 51 and the toe portion 53 are knitted, stitches are increased and decreased along gore lines 54a and 54b. When the leg portion 50 and the instep portion 52 are knitted, the knitting cylinder 1 is continuously rotated only in the forward direction. On the other hand, when the heel portion 51 and the toe portion 53 are knitted, the knitting cylinder is rotated alternately in forward and backward directions or oscillated as is known in the art.

Operation of up-picker mechanism

When the heel portion and the toe portion are knitted, knitting needles with the butt 2a are used. As shown in FIG. 3, when the knitting cylinder 1 rotates forward and backward in oscillation, the butt 2a of a knitting needle 2 moves the front end portion 17a of the right-side up-picker 17 leftward against the force of the coil spring 19a. At this time, the butt 2a is caused to engage into the recess portion on the right of the front end portion 17a. As viewed in FIG. 3, the up-picker 17 is thereby rotated about the vertical shaft 11 clockwise. Thus, the rear end portion 17*b* of the up-picker 17 is lowered along the inclined guide slot 20*a*. Consequently, the front end portion 17*a* is raised and moved to a position above the center cam 8. Meanwhile, the swing lever 13 rotates about the vertical shaft 11 clockwise through the coil spring 19*a*.

Figure 11:
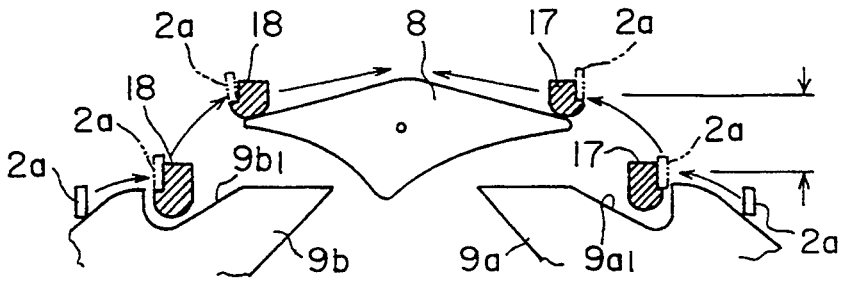
FIG. 11 is a schematic diagram for explaining the relation among a center cam, stitch cams, and up-pickers.

FIG. 11 shows the operation of the above-described up-picker 17. As shown in this figure, the up-picker 17 is initially placed in a recess 9*a*l of the right-side stitch cam 9*a*. The up-picker 17 is abutted by the butt 2*a* and raises the butt 2*a* to a non-knitting level above the center cam 8. Thus, the knitting needle 2 with the butt 2*a* does not form a stitch. In other words, one stitch is decreased.

When the swing lever 13 rotates clockwise, the arm lever 13*a* rotates the interconnection lever 16 in an arrow direction shown in FIG. 3 (counterclockwise). Thus, the left-side swing lever 14 is caused to rotate clockwise. This rotation is transmitted to the left-side up-picker 18 through the coil spring 19*a*. Thus, the rear end portion 18*b* is pushed toward a higher portion of the inclined guide slot 20*b*. Consequently, the up-picker 18 rotates about the vertical shaft 11 clockwise. The front end portion 18*a* is thereby lowered and enters into the recess 9*b*l of the left-side stitch cam 9*b*.

In FIG. 3, the above-described operation applies equally to the operation of the up-picker 18. In other words, when the butt 2*a* of a knitting needle 2 moves rightward, it comes in contact with the front end portion 18*a* of the up-picker 18. The operation of the up-picker 18 is shown in the left half of FIG. 11.

The alternate rotations (oscillation) in forward and backward directions of the knitting cylinder 1 cause the up-pickers 17 and 18 to alternately rise and lower. In other words, as shown in FIGS. 8 and 9, the up-pickers 17 and 18 alternately place the needles with the butts 2*a* above the center cam 8, thereby decreasing the knitting range of the needles 2 from a range L1 to a range L2.

As described above, the up-pickers 17 and 18 are constantly urged by the coil springs 19*a* in such a manner that the front end portions 17*a* and 18*a* thereof are moved downward. The rear end portions 17*b* and 18*b* of the up-pickers 17 and 18 are moved constrainedly along the inclined guide slots 20*a* and 20*b*, respectively. Thus, the hosiery knitting machine is stably operated even at high speed. The engaging portions between the swing levers 13 and 14 and the interconnection lever 16 undergo wear to a lesser degree than conventional link mechanisms using connection pins.

Figure 8:
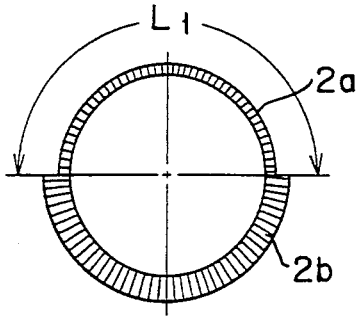
FIG. 8 is a plan view showing butts of knitting needles.
Figure 9:
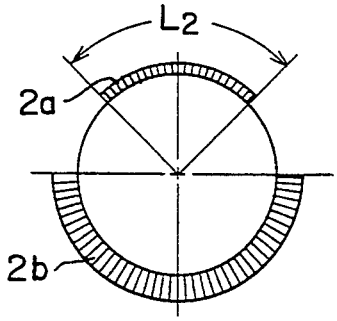
FIG. 9 is a plan view showing the butts of knitting needles in a different state.

After stitches are decreased from the state of FIG. 8 and to that of FIG. 9, stitches must be increased by the above-described down-picker mechanism B.

Operation of down-picker mechanism

Figure 5:
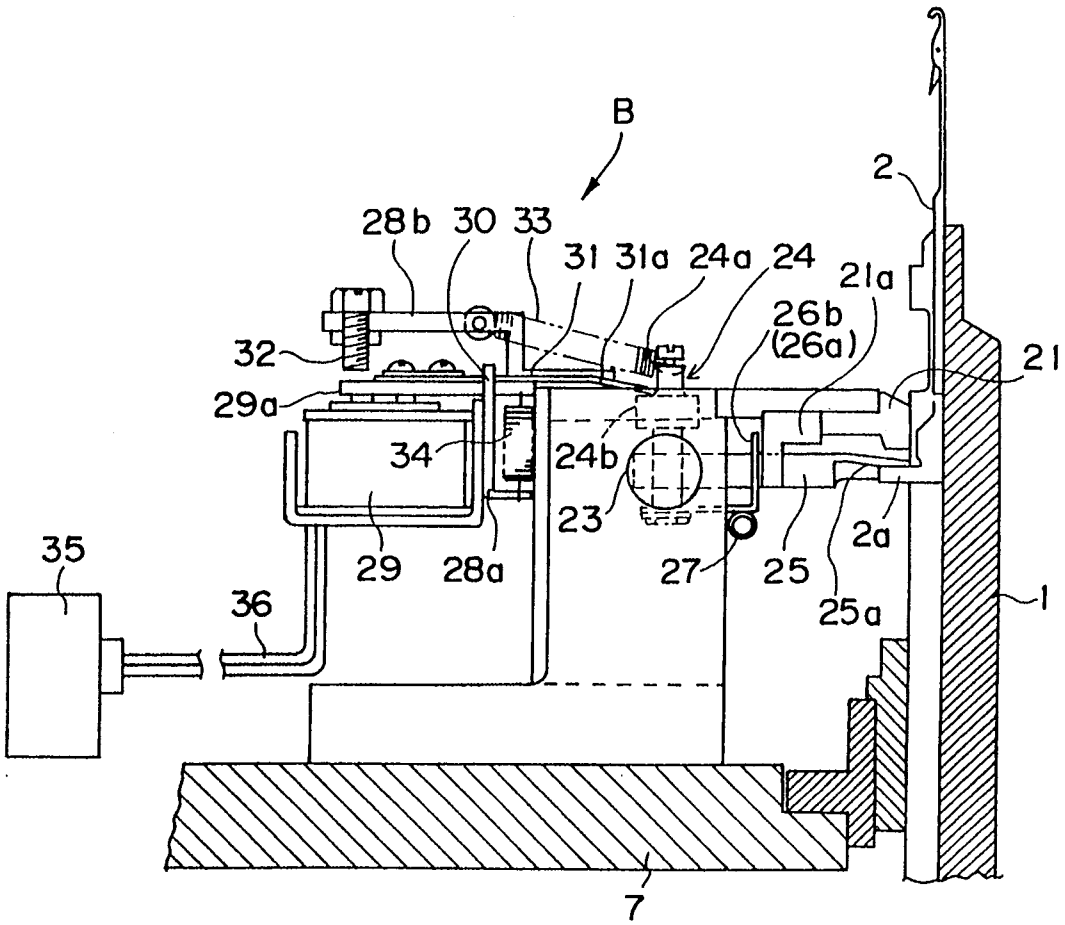
FIG. 5 is a partial sectional side view showing the down-picker mechanism.

When the heel portion and the toe portion are knitted, the knitting cylinder 1 is oscillated or rotated alternately forward and backward. For this purpose, the butt 2*a* of a knitting needle 2 placed at the non-knitting level is lowered from within the bottom concavity of the leveling cam 21 by means of the down-picker 25 so as to increase the stitches. In other words, in the condition shown in FIG. 6, when the actuator 29 is energized with a signal received from the knitting control unit 35 storing a knitting program, the actuator 29 attracts the attraction piece 29*a* as shown in FIG. 5. Thus, the working piece 31 integral with the attraction piece 29*a* is rotated against the elastic force of the coil spring 34 about the support 30. Consequently, the working piece 31 is disengaged from the large diameter portion 24*b* of the stop shaft 24. The stop shaft 24 is thereby rotated counterclockwise by the elastic force of the coil spring 33 about the horizontal shaft 23. The free end portion 31*a* of the working piece 31 thus comes in contact with the small diameter portion 24*a* of the stop shaft 24, while the down-picker 25 is rotated to a horizontal position. When the knitting cylinder 1 rotates forward, the butts 2*a* of two knitting needles 2 come in contact with the down-picker 25, thereby pushing it leftward (as viewed in FIG. 4). Thus, the down-picker 25 comes in contact with the inclined cam portion 21*a*l that lowers toward the left of the cam guide member 21*a*. Consequently, the down-picker 25 is moved in a leftward and downward direction against the elastic force of the coil spring 33. Since the down-picker 25 and the horizontal shaft 23 rotate together, the stop shaft 24 integral with the horizontal shaft 23 is also rotated in the same direction as shown in FIG. 6. Thus, the next butt 2*a* does not come in contact with the down-picker 25, but passes beyond it.

After the arrangement of the long butts 2*b* (see FIGS. 8 and 9) of the knitting needles 2 have passed, the actuator 29 is deenergized with a signal received from the knitting control unit 35. Thus, the working piece 29*a* is released from the attraction. At this time, since the free end portion 31*a* of the working piece 31 is engaged with the large diameter portion 24*b* as shown in FIG. 6, the down-picker 25 is inclined in a rightward and downward direction. However, the urging levers 26*a* and 26*b* elastically rotate the down-picker 25 in the horizontal direction, thereby returning the down-picker 25 to the neutral position below the leveling cam 21 (see FIG. 7).

Figure 12:
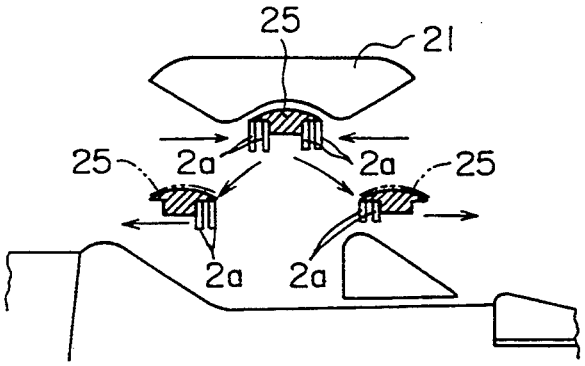
FIG. 12 is a schematic diagram for explaining the relation between a leveling cam and a down-picker.

As described above, when the butts 2*a* come in contact with the down-picker 25, the down-picker 25 is lowered. This operation is shown in the left half of FIG. 12. Recessed portions are likewise formed at both the sides of the down-picker 25 as in the case of the up-picker 17. As 10 shown in FIG. 12, two butts 2*a* are caused to engage the recessed portions. Thus, two knitting needles 2 are returned concurrently from the non-knitting level to the knitting level.

The operation in the case when the knitting cylinder 1 rotates backward is the same as the operation in the case when the knitting cylinder 1 rotates forward. In FIG. 4, the down-picker 25 is moved rightward by the butts 2*a*. The down-picker 25 is guided by the right-side cam portion 21*a*2 of the cam guide member 21*a* and lowered. The operation of the down-picker 25 is shown in the right half of FIG. 12. Thus, two knitting needles 2 are lowered to the knitting level at a time. In this case, the coil spring 27 returns the down-picker 25 to the neutral position below the leveling cam 21, where the down-picker 25 waits for the next operation.

Since the long butts 2 do not participate in knitting the heel portion and the toe portion, they are moved to a float course FC at the low end level of the stitch cams 9*a* and 9*b* (see FIG. 7). While the butts 2*a* are in a knitting course KC, the knitting cylinder 1 alternately rotates forward and backward so as to knit the heal portion and the toe portion. As in the case of the operation of the up-pickers, the butts 2*a* of the knitting needles 2 raised above the center cam 8 in the non-knitting level is lowered by the down-picker 25 placed in the bottom concavity of the leveling cam 21, thereby increasing stitches. In other words, as the knitting cylinder 1 alternately rotates forward and backward, two butts 2*a* on the center cam 8 at the non-knitting level are lowered to the knitting course KC at a time.

According to the present invention, after the down-picker 25 has lowered first two butts 2*a* to the knitting course KC, the remaining butts 2*a* and thereafter the butts 2*b* pass through the upper surface of the front end 25*a* of the down-picker 25. During this operation, it is necessary to prevent the down-picker 25 from rising and returning into the bottom concavity of the leveling cam 21. Otherwise, butts 2*a* that should not be lowered would be lowered. To prevent this problem, while the butts 2*b* are passing through the position of the down-picker 25 and after the butts 2*a* are lowered by the down-picker 25, the actuator 29 is switched from the energized state to the deenergized state by a signal from the knitting control unit 35. Thus, the free end portion 31*a* of the working piece 31 is engaged with the large diameter portion 24*b* of the stop shaft 24. As shown in FIG. 6, the front end 25*a* of the down-picker 25 is thus kept in a non-working position where the front end 25*a* does not come in contact with the butts 2*a*.

To return the down-picker 25 to the initial working position (shown in FIG. 5), the actuator 29 is energized by a signal received from the knitting control unit 35 so as to attract the attraction piece 29*a* against the force of the coil spring 34. Thus, the free end 31*a* of the working piece 31 moves from the large diameter portion 24*b* of the stop shaft 24 to the small diameter portion 24*a* thereof. The horizontal shaft 23 and the down-picker 25 are returned to positions as shown in FIG. 5 for the next down-picker operation.

By oscillating the knitting cylinder 1 forward and backward, the down-picker 25 is lowered from within the bottom concavity of the leveling cam 21. Thus, two butts 2*a* are lowered at a time. The knitting range L2 of the needles 2 with the butts 2*a* shown in FIG. 9 is thus increased to the knitting range L1 shown in FIG. 8 so as to knit the heel portion and the toe portion.

According to the present invention, even if a region lacking the butts of a width T (FIG. 7) that is larger than the width t of the front end of the down-picker 25 passes through a non-knitting level NKC (FIG. 7), jacquard patterns can be reliably knitted with a pattern generating program.

When the leg portion and the instep portion of hosiery are knitted to have a jacquard patterns with two colors, a first color yarn and a second color yarn are supplied from different feeders. As shown in FIG. 7, while the second color yarn is being knitted, knitting needles 2*b*l that knit the first color yarn are in the non-knitting course NKC. On the other hand, while the first color yarn is being knitted, knitting needles 262 that knit the second color yarn are in the float course FC. These knitting needles take the knitting course KC (see FIG. 7) during knitting. As is known in the art, whether the knitting needles with the butts 2*b* take the non-knitting course NKC or the float course FC is determined by a needle selection device. The knitting needle width T in the float course FC (namely, the width of the region lacking the butts in the non-knitting course) depends on how many knitting needles take the non-knitting course NKC. When the knitting operation shifts from the leg portion to the heel portion, needles (for knitting the instep portion) with the butts 2*b* that are disposed in half the circumference of the knitting cylinder take the float course FC. Needles with the butts 2*a* that are disposed on the remaining half circumference knit the heel portion. During this operation, as described above, the needles with the butts 2*a* are successively raised to the non-knitting level from the opposite sides so as to decrease the number of stitches. Next, the needles are successively lowered to the knitting level so as to increase the number of stitches.

Assume that such a wide jacquard pattern is knitted by using the conventional picker device and that the width T of the butts of the knitting needles in the float course FC is larger than the width t of the front end 25*a* of the down-picker 25. In such a case, when the butts of the knitting needles that are in the non-knitting course NKC frictionally pass over the upper surface of the down-picker 25, the down-picker that is to be placed in the lowered non-operative position is raised to the operative position immediately below the leveling cam 21 toward the region lacking the butts of the width T that is larger than the width t of the down-picker 25. Thus, the down-picker 25 acts on and lowers some of the knitting needles in the non-knitting course NKC. Consequently, the heel portion cannot be correctly knitted, and disorder of the pattern to be knitted occurs.

However, according to the down-picker mechanism of the present invention, the actuator 29 securely holds the down-picker 25 at the non-operative position, so that some of the knitting needles in the non-knitting course KC are not lowered by the down-picker 25, to the knitting course KC, whereby disorder of the pattern does not occur.

Modification of Embodiment

In the case of the above-described down-picker mechanism, the down-picker 25 moved under the force of the coil springs 33 and 27. Thus, even if the knitting machine operates at high speed, the down-picker 25 operates stably without jumping due to rebounding.

As described above, before the heel portion and toe portion of hosiery are knitted, the knitting cylinder continuously rotates forward. Only when the heel portion and toe portion are knitted, the knitting cylinder alternately rotates forward and backward so as to decrease and increase the stitches. When the stitches are increased, two butts are lowered at a time to the knitting level by the down-picker. After the two butts are thus lowered to the knitting level, the down-picker cannot be returned to the initial position in the concavity of the leveling cam unless all the butts have passed the down-picker. Unless the down-picker is present in the start position in the concavity of the leveling cam, the down-picker cannot be abutted at its end portion by the butts of the needles that come in the next backward rotation of the knitting cylinder, and therefore the down-picker cannot be lowered to move the needles to the knitting level. Thus, until all the butts pass the down-picker, the down-picker should wait at the lowered position. To reduce the waiting time, the speed of alternate forward and backward rotations or oscillation of the knitting cylinder must be increased.

In the hosiery knitting machine, the knitting cylinder respectively makes alternate forward and backward rotation with a basic angular velocity of approximately 1 turn (360°) to knit the heel portion and toe portion of hosiery. Thus, if the knitting cylinder rotates at high speed, inertia force due to angular acceleration will become large. In addition, the knitting operation of the heel portion and toe portion cannot follow the high speed of the knitting machine. Thus, knitting needles may be broken and/or the cam mechanism will undergo wear. Moreover, the tension applied to the yarn will become too large. Furthermore, constructional elements of the machine will wear, accompanied by frictional heat, whereby the knitting operation will become unstable and the quality of the knitted products will deteriorate.

A modification of the embodiment that can solve such a problem will be described below.

Figure 14:
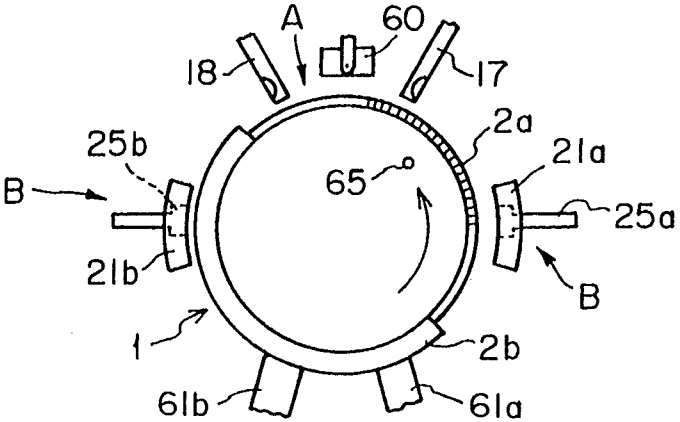
FIG. 14 is a plan view according to a modification of the embodiment of FIG. 13.
Figure 15:
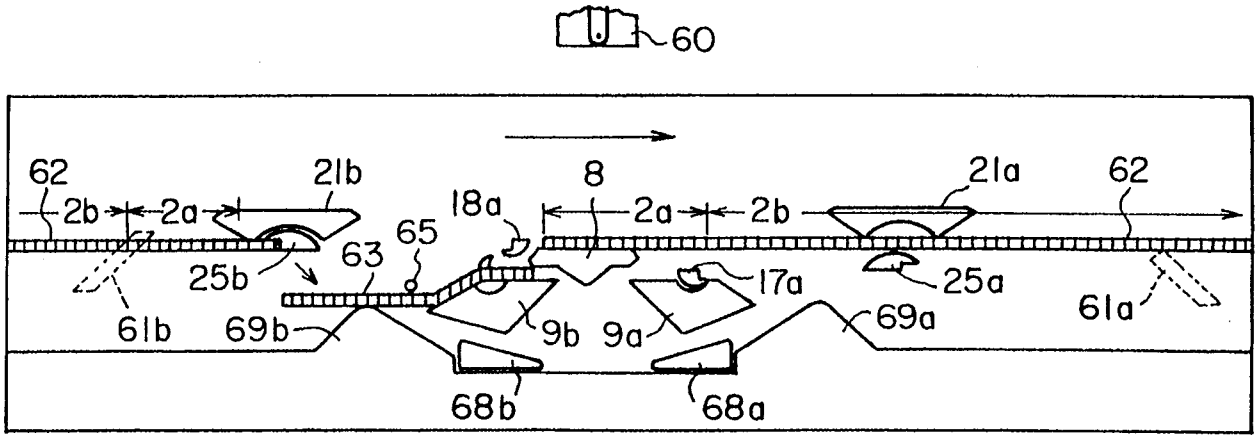
FIG. 15 is a development diagram similar to FIG. 13 but showing a different working condition from FIG. 13.
Figure 16:
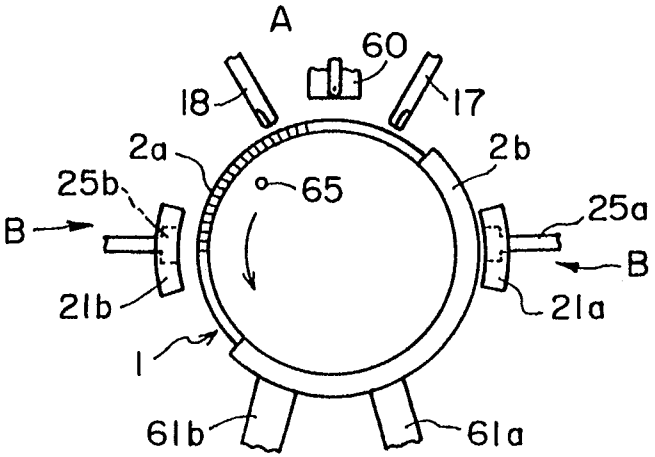
FIG. 16 is a plan view of FIG. 15.

As shown in FIG. 2, according to the embodiment of the present invention described before, the up-picker mechanism A is placed in opposition to the down-picker mechanism B with the knitting cylinder 1 therebetween in the diametrical direction thereof. In contrast, according to the modification of the embodiment, as shown in FIG. 14, two down-picker mechanisms B, B are disposed at positions angularly spaced apart from an up-picker mechanism A by approximately 90°. One of the down-picker mechanisms B, B has a leveling cam 21*a* and a down-picker 25*a*. The other down-picker mechanism B has a leveling cam 21*b* and a down-picker 25*b*. As shown in FIG. 14, a yarn feeder 60, a needle-raising switch cam 61*a*, and a needle lowing switch cam 61*b* are disposed around the knitting cylinder 1. Reference numeral 65 represents a reference position (corresponding to the center position of the heel portion of hosiery).

Figure 13:
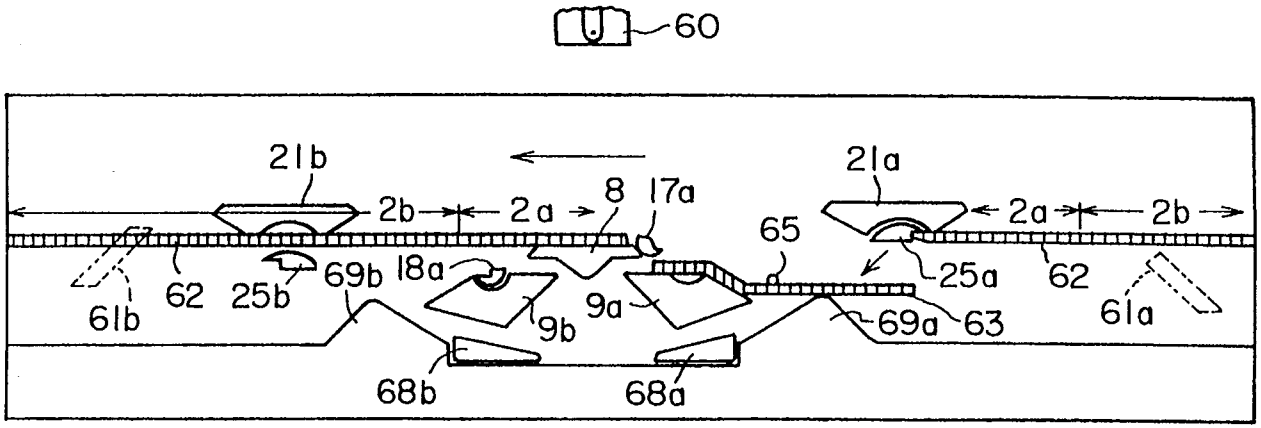
FIG. 13 is a development diagram showing the relation among various cams, needle butts, and down-picker of the hosiery knitting machine.

FIG. 13 is a development diagram of various cams. In this figure, a right-side stitch cam 9*a* and a left-side stitch cam 9*b* are disposed on the right and left of the center cam 8, respectively. The right-side stitch cam 9*a* and the left-side stitch cam 9*b* have upwardly open recesses in which a known right-side up-picker 17*a* and a known left-side up-picker 18*a* can be placed, respectively. A right-side cushion cam 68*a* and a left-side cushion cam 68*b* are disposed below the right-side stitch cam 9*a* and the left-side stitch cam 9*b*, respectively. A right-side cam 69*a* and a left-side cam 69*b* are disposed in the vicinity of the right-side cushion cam 68*a* and the left-side cushion cam 68*b*, respectively. A right-side leveling cam 21*a* and a left-side leveling cam 21*b* are disposed apart from the center cam 8 by approximately 90° (approximately $\frac{1}{4}$ of the circumference). The right-side leveling cam 21*a* and the left-side leveling cam 21*b* have lower concavity in which the right-side down-picker 25*a* and the left-side down-picker 25*b* can be placed, respectively. The raising switch cam 61*a* and the lowering switch cam 61*b* are disposed apart from the leveling cams 21*a* and 21*b* by approximately 90° (approximately, $\frac{1}{4}$ circumference), respectively. The switch cams 61*a* and 61*b* are movable in radial directions of the knitting cylinder 1. After the heel portion (toe portion) has been knitted, the needle lowering switch cam 61*b* lowers the needles with the long butt 2*a* to the knitting level 63. The yarn feeder 60 is disposed above the center cam 8.

Next, the operation of the modification of the embodiment will be described.

Knitting operation for decreasing stitches by up-pickers

The knitting operation for decreasing the stitches by the up-pickers is performed in the following manner.

In FIGS. 13 and 14, before the heel portion (toe portion) is knitted, the knitting cylinder 1 rotates forward (namely, counterclockwise). In other words, needles with short butt 2*a* and needles with long butt 2*b* pass through the right-side cam 69*a* and are then cleared by the right-side stitch cam 9*a*. The needles with short butt 2*a* and needles with long butt 2*b* make knitting operation, using a yarn supplied from the yarn feeder 60, from the center cam 8 to the left-side stitch cam 9*b*. Thereafter, the needles are returned to the tack line by the left-side cam 69*b*. By repeating these steps, the knitting operation is performed. During the operation, the raising switch cam 61*a* and the lowering switch cam 61*b* are retracted to the non-operative position.

When the heel portion (toe portion) is knitted, the needle raising switch cam 61*a* is moved toward the axis of the knitting cylinder 1. When the heel porion (toe portion) is knitted, the needle raising switch cam 61*a* raises only the needles with the long butt 2*b* from the knitting line 63 to the non-knitting line 62.

Thus, the needles with the short butt 2*a* that are disposed on half the circumference of the knitting line 63 operate to knit the heel portion (toe portion). During this operation, the right-side down-picker 25*a* and the left-side down-picker 25*b* are lowered from the concavities of the right-side leveling cam 21*a* and the left-side leveling cam 21*b* to their non-operative positions so as not to interfere with the needles with the long butt 2*b* in the non-knitting line 62.

Next, the knitting cylinder 1 alternately rotates forward and backward until the heel portion (toe portion) has been knitted. When the knitting cylinder 1 rotates backward or reversely, a first needle with the short butt 2*b* in the knitting line 63 is moved to the non-knitting line 62 by the left-side up-picker 18*a*.

When the knitting cylinder 1 rotates forward, a first needle with the short butt 2*a* in the knitting line 63 is moved to the non-knitting line 62 by the right-side up-picker 17*a*.

When the knitting cylinder 1 thus repeats the alternate (forward and backward) rotations, the right-side up-picker 17*a* and the left-side up-picker 18*b* alternately move right end and left end needles with the short butt 2*a* in the knitting line 63 to the non-knitting line 62 (the line of the needles with the long butt 2*b*). Thus, stitches are gradually decreased so that a predetermined knitting width can be obtained.

Consequently, an arrangement of needles with the long butt 2*b* is formed in the non-knitting line 62, while on both sides of this arrangement, arrangements of a predetermined number of needles with the short butt 2*a* are formed.

Stitches are thus decreased by the right-side up-picker 17*a* and the left-side up-picker 17*b*.

Knitting operation for increasing stitches by down-pickers

Figure 17:
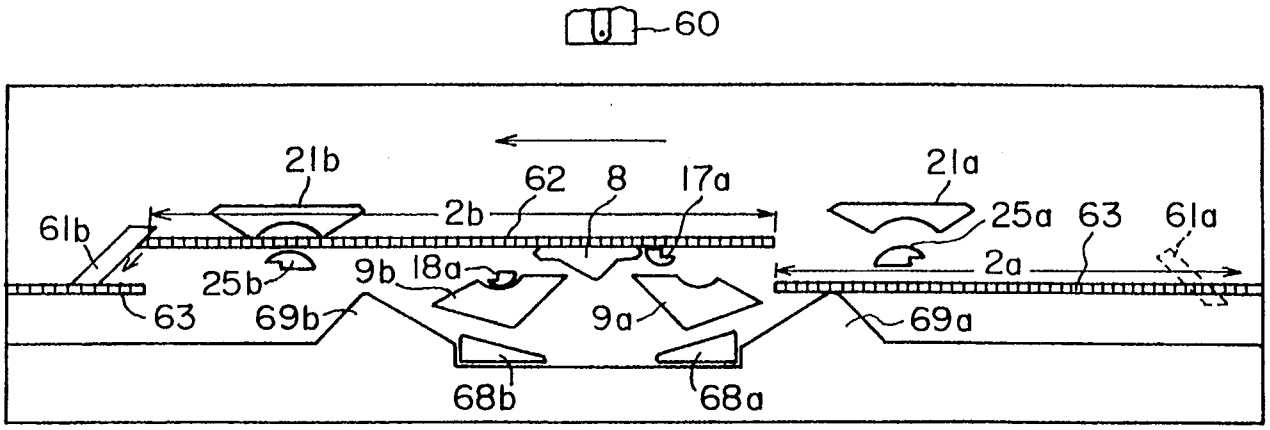
FIG. 17 is a development diagram similar to FIG. 13 but showing a different working condition from FIG. 13.
Figure 18:
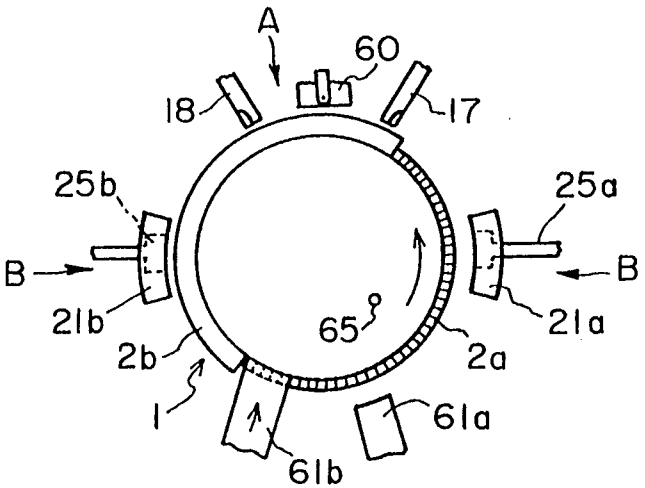
FIG. 18 is a plan view of FIG. 17.

As shown in FIGS. 13 and 14, when the knitting cylinder 1 rotates backward (clockwise), first two needles of the needles with the short butt 2*a* moved to the non-knitting line 62 are lowered at a time to the knitting line 63 by each of the right-side down-picker 25*a* and the left-side down-picker 25*b*. As described above, since the right-side down-picker 25*a* is disposed with a phase difference of approximately $\frac{1}{4}$ of the circumference to the right, the angular acceleration of the knitting cylinder 1 in the leftward direction can be decreased to the acceleration corresponding to approximately $\frac{1}{4}$ of the circumference of the knitting cylinder. Similarly, since the left-side down-picker 25*b* is disposed with a phase difference of approximately $\frac{1}{4}$ of the circumference to the left, the angular acceleration to the right of the knitting cylinder 1 can be decreased to the acceleration corresponding to approximately $\frac{1}{4}$ of the circumference of the knitting cylinder (see FIGS. 17 and 18).

INDUSTRIAL APPLICABILITY

The present invention can be used for gradually increasing and decreasing stitches of hosiery including socks and stockings.

We claim:

1. A picker device of a hosiery knitting machine having a knitting cylinder, a machine frame provided outside the knitting cylinder, a center cam, a pair of first and second stitch cams, and a leveling cam, the knitting cylinder supporting a number of knitting needles for upward and downward movement, the knitting needles having butts, respectively, the center cam being supported by the machine frame, the first and second stitch cams being disposed on both sides of the center cam, the leveling cam being supported by the machine frame, said picker device comprising:

an up-picker mechanism; and a down-picker mechanism, wherein said up-picker mechanism comprises:

a first up-picker formed in a lever shape and having a first front end portion and a first rear end portion, the first front end portion being disposed above the first stitch cam, the first rear end portion being disposed at a far side of the knitting cylinder;

first support means for supporting said first up-picker at an intermediate portion thereof so that said first up-picker is rotatable about a vertical axis and a horizontal axis;

a second up-picker formed in a lever shape and having a second front end portion and a second rear end portion, the second front end portion being disposed above the second stitch cam, the second rear end portion being disposed at a far side of the knitting cylinder;

second support means for supporting said second up-picker at an intermediate portion thereof so that said second up-picker is rotatable about a vertical axis and a horizontal axis;

first inclined guide means engaging the first rear end portion of said first up-picker for gradually lowering said first rear end so as to move the first front end portion of said first up-picker to an upper position above the center cam along with a knitting needle that is caused to abut against the first front end portion, when the butt of the knitting needle in a knitting level of the knitting cylinder rotating in a first direction is caused to move to and abut against the first front end portion of said first up-picker to move the first front end portion in such a manner that said first up-picker is rotated about the vertical axis;

first elastic means for applying such a force to said first up-picker to lower the first front end portion;

second inclined guide means engaging the second rear end portion of said second up-picker for gradually lowering said second rear end so as to move the second front end portion of said second up-picker to an upper position above the center cam along with a knitting needle that is caused to abut against the second front end portion, when the butt of the knitting needle in a knitting level of the knitting cylinder rotating in a second direction is caused to move to and abut against the second front end portion of said second up-picker to move the second front end portion in such a manner that said second up-picker is rotated about the vertical axis;

second elastic means for applying such a force to said second up-picker to lower the second front end portion; and interconnection means for coupling and rotating said first up-picker and said second up-picker in the same direction about the vertical axis and in opposite directions about the horizontal axis;

wherein said down-picker mechanism comprises:

a down-picker having a front end portion and a rear end portion, the front end portion being disposed immediately below the leveling cam, the rear end portion being disposed on a far side of said knitting cylinder, the down-picker being supported at the rear end portion thereof for upward and downward rotation by a horizontal shaft;

means for supporting the rear end portion of said down-picker so that the down-picker is rotatable horizontally from a neutral position thereof;

cam guide means for moving said down-picker downward when the down-picker is rotated horizontally from the neutral position;

locking means for locking rotating position of said horizontal shaft so that said down-picker is selectively placed at a first rotating position or a second rotating position of the horizontal shaft, the front end portion of said down-picker at the first rotating position being adapted for contact with the butt of the knitting needle in the non-knitting level, the front end portion of said down-picker at the second rotating position being free from contact with the butt of the knitting needle in the non-knitting level; and elastic means for urging said down-picker toward the leveling cam.

2. The picker device as set forth in claim 1, wherein each of said first support means and said second support means comprises:

a vertical shaft rotatably supported by the machine frame;

a trunk portion of the vertical shaft;

slot means formed in said trunk portion and extending along the trunk portion; and a horizontal pin disposed in said slot means for pivoting said first up-picker or said second up-picker.

3. The picker device as set forth in claim 1, wherein each of said first inclined guide means and said second inclined guide means comprises a member secured to the machine frame and having an inclined guide slot.

4. The picker device as set forth in claim 1, wherein said up-picker mechanism further comprises:

a first swing lever with a base pivoted about the vertical axis of said first up-picker, and wherein said first elastic means is a tension spring for connecting the rear end portion of said first up-picker and said first swing lever.

5. The picker device as set forth in claim 4, wherein said up-picker mechanism further comprises:

a second swing lever with a base pivoted about the vertical axis of said second up-picker, and wherein said second elastic means is a tension spring for connecting the rear end portion of said second up-picker and said second swing lever.

6. The picker device as set forth in claim 1, wherein said interconnection means is a swingable lever with a center portion pivoted by a vertical shaft disposed between said first swing lever and said second swing lever, the interconnection lever having two end portions engaging said first swing lever and said second swing lever.

7. The picker device as set forth in claim 1, wherein the rear end portion of said down-picker is supported in the horizontal shaft so that the front end portion thereof is rotatable horizontally.

8. The picker device as set forth in claim 1, wherein said cam guide means and the leveling cam are disposed on the same side with respect to the circumference of the knitting cylinder.

9. The picker device as set forth in claim 1, wherein said locking means comprises:

knitting control means;

an actuator having an operative state and a non-operative state depending upon a signal received from said knitting control means; and working means disposed between said actuator and the horizontal shaft for causing the horizontal shaft to rotate to the first rotating position when said actuator is in the operative state and for causing the horizontal shaft to rotate to the second rotating position when said actuator is in the non-operative state.

10. The picker device as set forth in claim 9, wherein said working means comprises:

a stop shaft disposed perpendicular to the horizontal shaft and having a large diameter portion and a small diameter portion; and a lever-shaped working piece rotatable depending upon the operative state or the non-operative state of said actuator and selectively engageable with one of the large diameter portion and the small diameter portion so as to change the rotating position of the horizontal shaft.

11. The picker device as set forth in claim 10, wherein said elastic means is a member acting on the stop shaft.

12. The picker device as set forth in claim 1, wherein said down-picker mechanism is disposed in opposition to said up-picker mechanism with the knitting cylinder disposed therebetween in a diametrical direction thereof.

13. The picker device as set forth in claim 1, wherein said down-picker mechanism and said up-picker mechanism are disposed with a phase difference of 90° along the circumference of the knitting cylinder.

* * * * *